US005802720A

United States Patent [19]

Pribe

[11] Patent Number: 5,802,720

[45] Date of Patent: Sep. 8, 1998

[54] SHAVING CLOTH

[76] Inventor: Christopher A. Pribe, 379 Hope St., Mountain View, Calif. 94041

[21] Appl. No.: 726,163

[22] Filed: Oct. 4, 1996

[51] Int. Cl.[6] ..... B26B 21/00

[52] U.S. Cl. ..... 30/32; 30/50; 30/346.5; 30/346.55; 30/49; 407/29.11

[58] Field of Search ..... 30/49, 32, 50, 30/41, 346.5, 346.55; 451/525, 449, 524; 407/29.11

[56] References Cited

U.S. PATENT DOCUMENTS

| | | | |
|---|---|---|---|
| 2,231,453 | 2/1941 | Pitar et al. | 451/524 |
| 2,311,060 | 2/1943 | Lurrain | 451/524 |
| 2,328,886 | 9/1943 | Andrews et al. | 451/524 |
| 2,614,321 | 10/1952 | Ackerman | 30/346.5 |
| 4,720,917 | 1/1988 | Solow | 30/49 |
| 4,754,548 | 7/1988 | Solow | 30/50 |
| 4,807,360 | 2/1989 | Cerier et al. | 30/49 |
| 4,845,848 | 7/1989 | Strickland | 30/49 |
| 4,850,107 | 7/1989 | Valliades et al. | 30/41 |
| 4,893,641 | 1/1990 | Strickland | 30/49 |
| 4,977,670 | 12/1990 | Iten | 30/49 |
| 4,979,298 | 12/1990 | Pesiri | 30/49 |

*Primary Examiner*—Maurina I. Rachuba
*Attorney, Agent, or Firm*—David H. Jaffer

[57] ABSTRACT

A razor consisting of a flexible cloth-like base material upon which are mounted a plurality of cutting heads. Each head is attached to the base material so as to be flexible in orientation. A preferred head embodiment includes a flat metal structure having an attachment hole for connection to the cloth and an aperture large enough for passage of one or more hairs, the perimeter of the aperture having a sharp edge for cutting the hair. The density, i.e. quantity of heads per unit area is preferably very large, resulting in some overlap of heads. In this dense configuration, the probability of a head engaging a hair is greatly increased, in spite of the somewhat random orientation of each head. This principle is more commonly known as the law of mass action. The dense, small cutting heads in combination with the flexible cloth-like base material provides a structure that easily conforms to body contours.

8 Claims, 12 Drawing Sheets

Fig. 1A
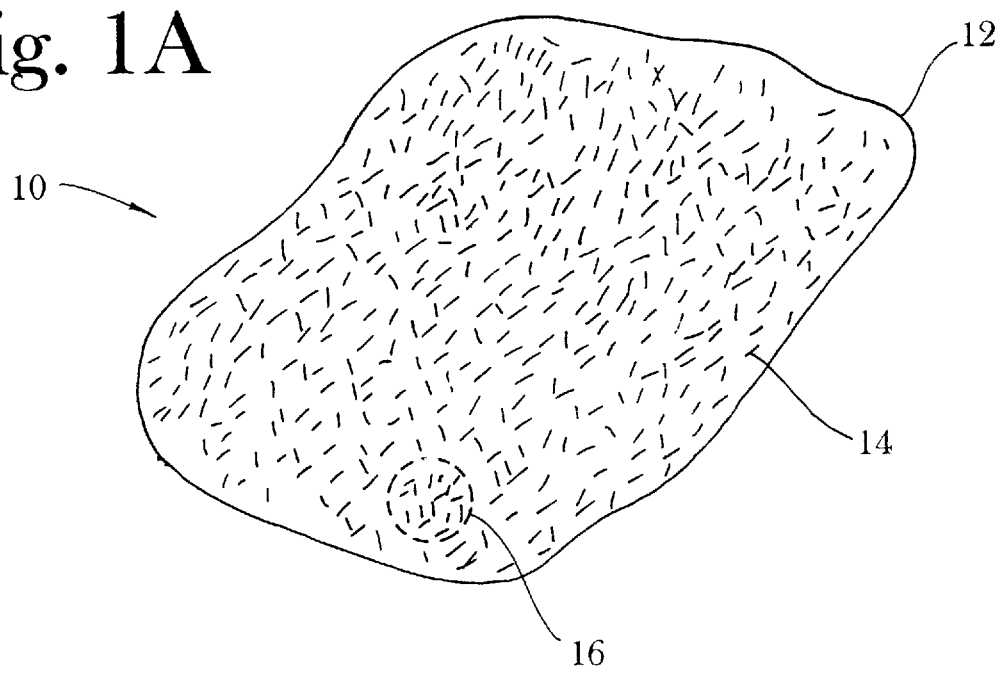
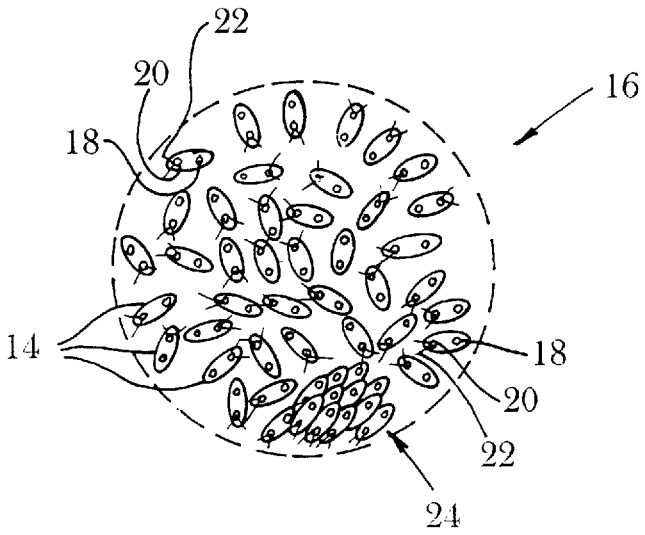
Fig. 1B

Fig. 2H
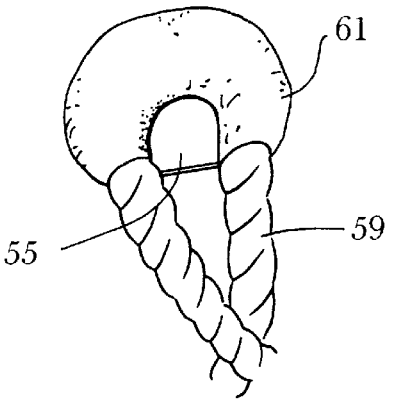
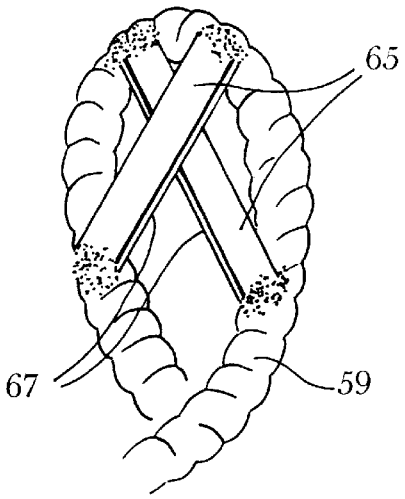
Fig. 2I
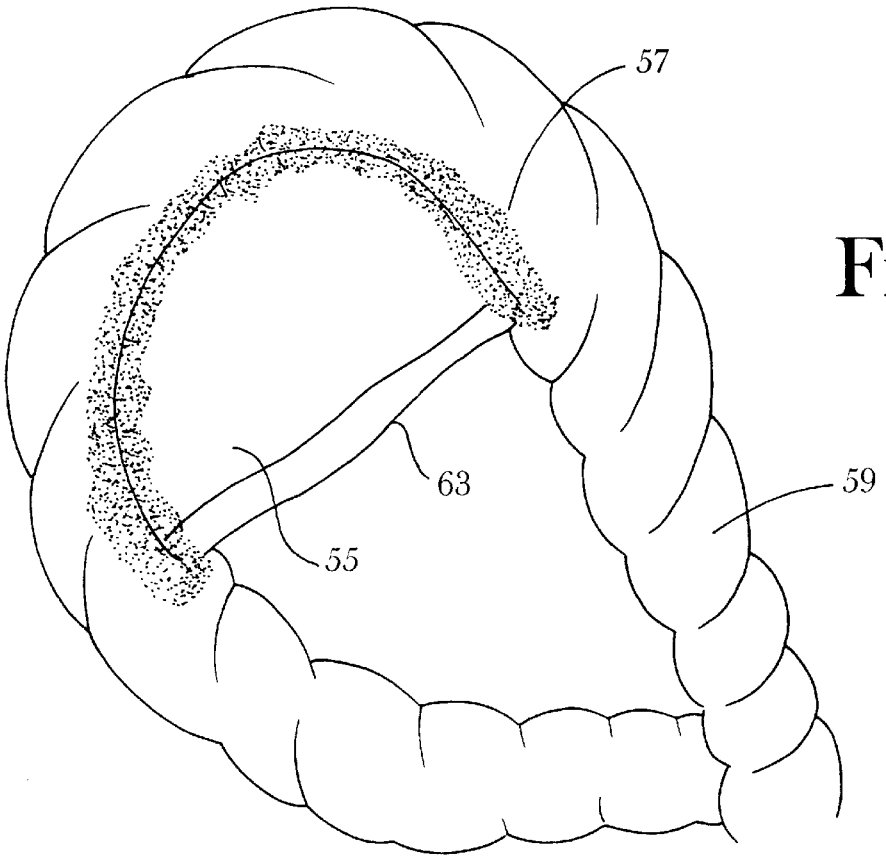
Fig. 2G

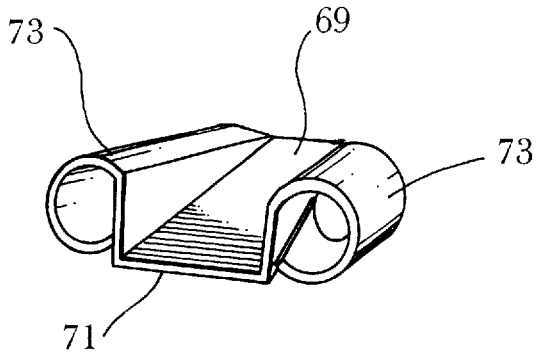
Fig. 2J
Fig. 2K
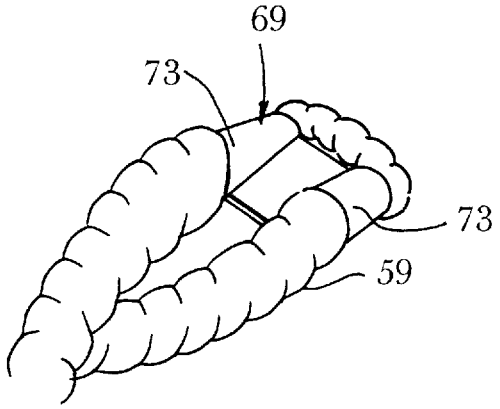
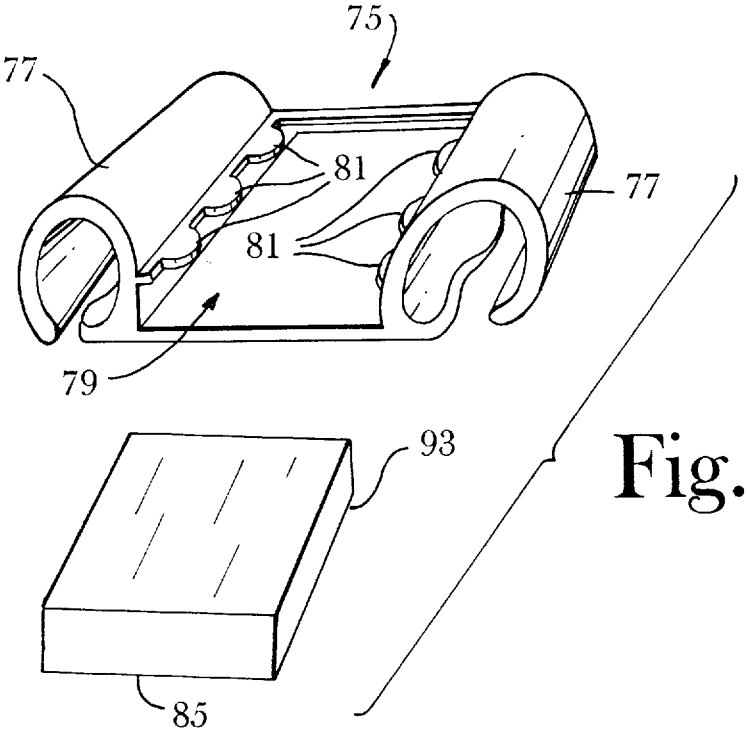
Fig. 2L

Fig. 6A
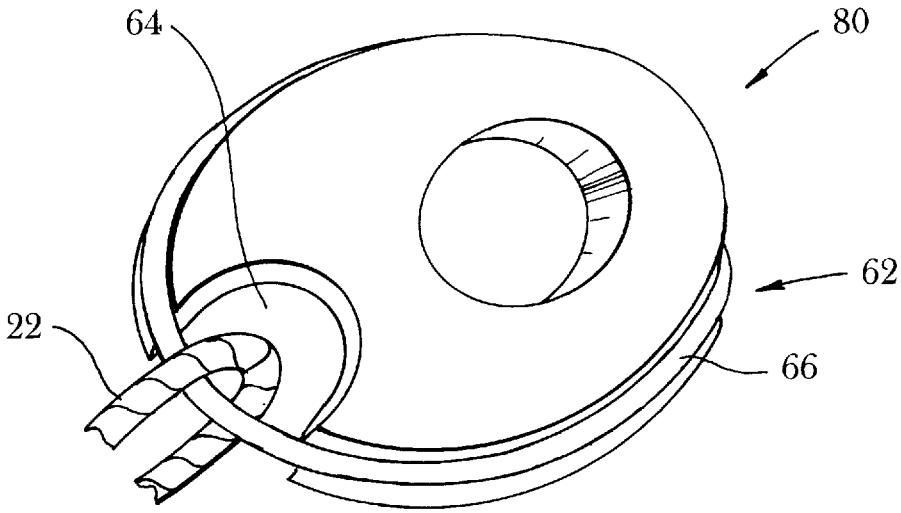
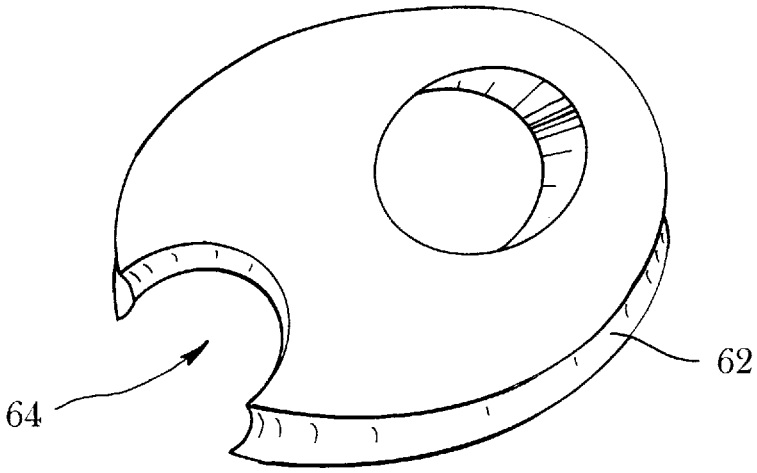
Fig. 6B

Fig. 7A
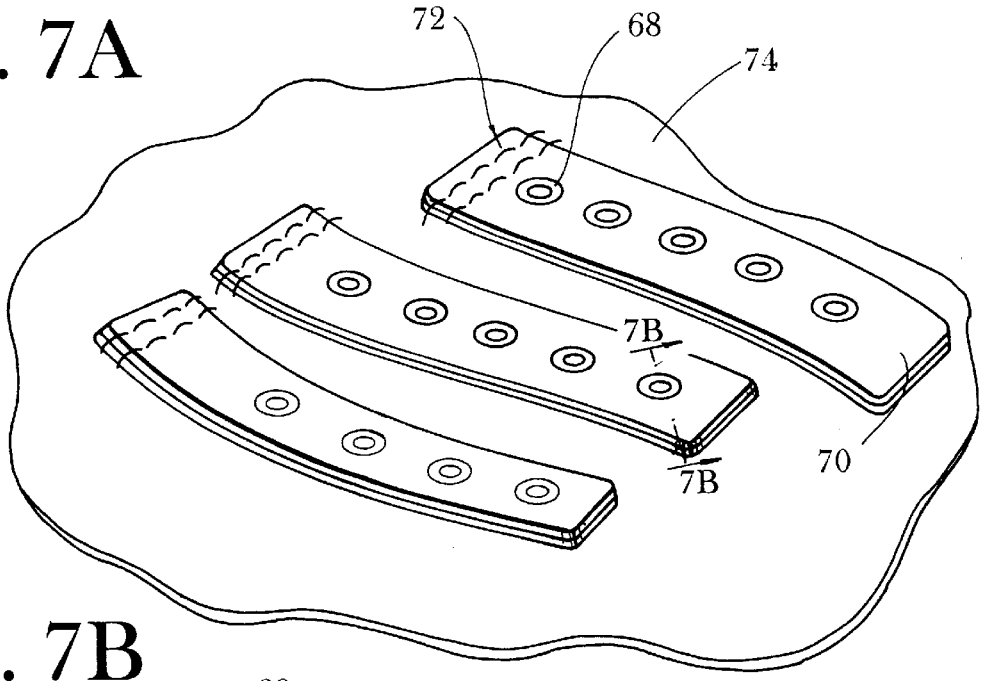
Fig. 7B
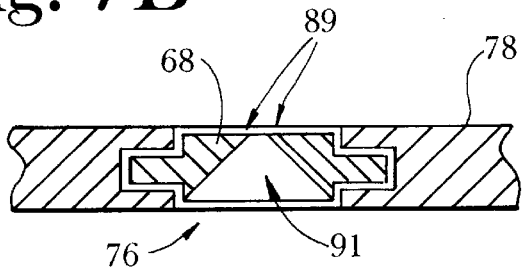
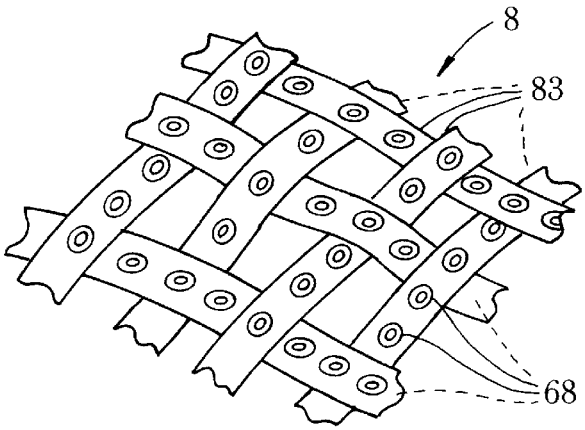
Fig. 7C
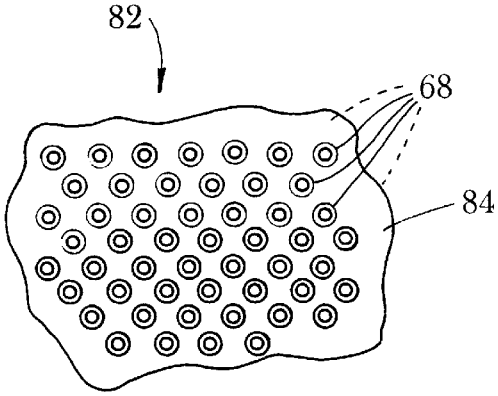
Fig. 8

Fig. 10
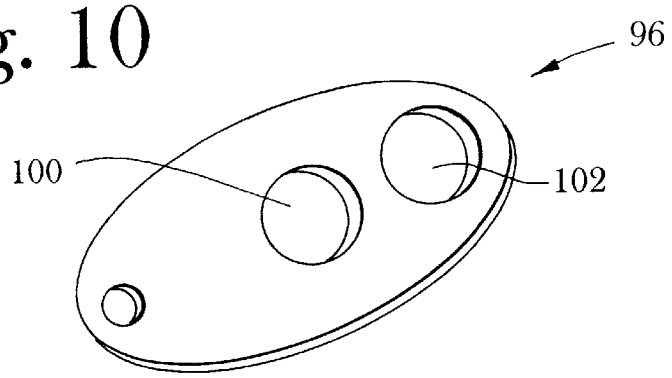
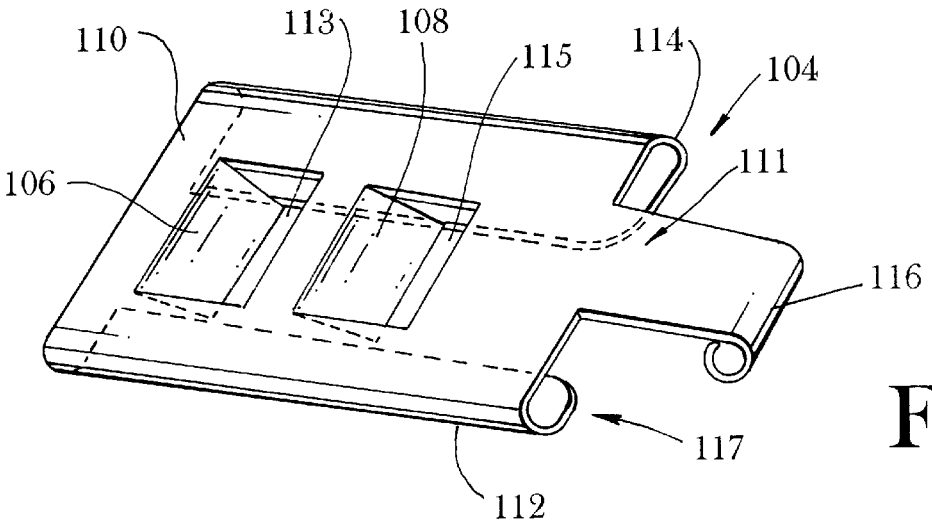
Fig. 11
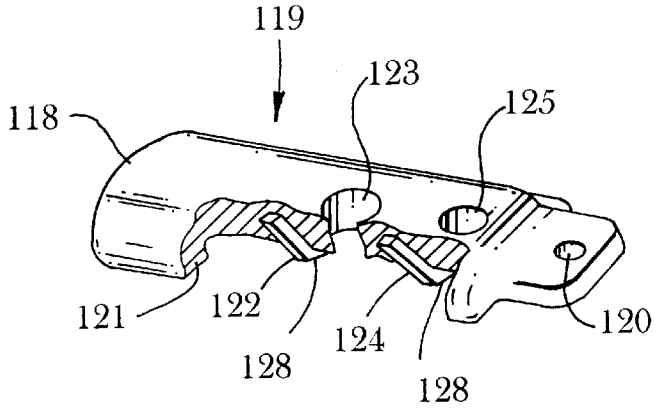
Fig. 12

Fig. 13
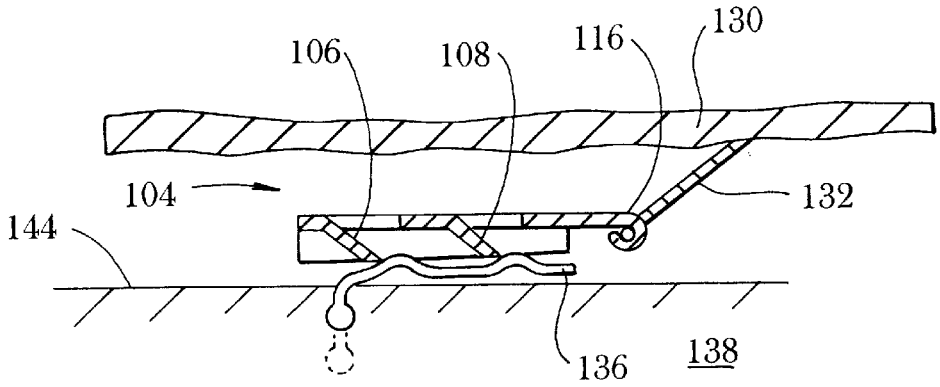
Fig. 14
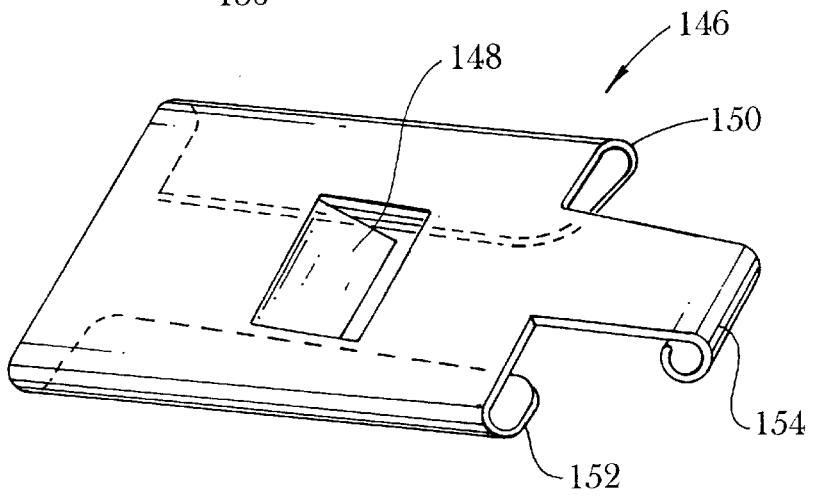
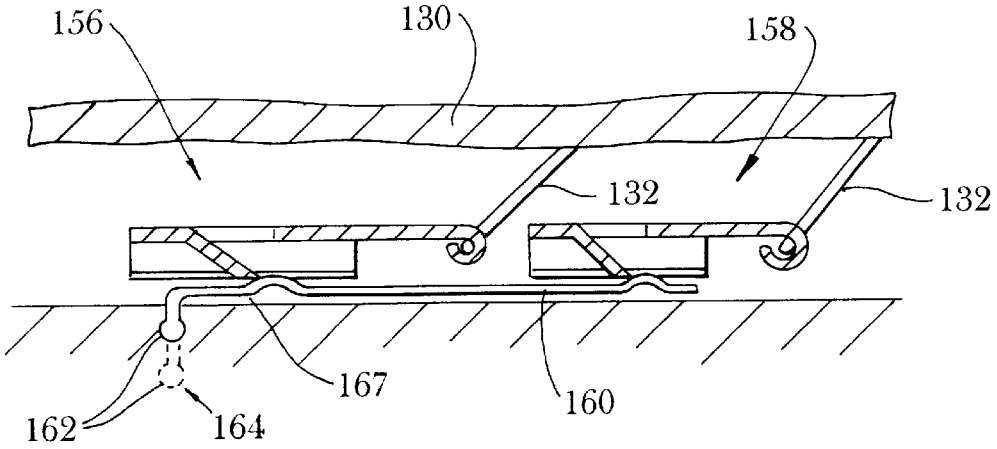
Fig. 15

SHAVING CLOTH

BACKGROUND OF THE INVENTION

1. Field of the Invention

The present invention relates generally to manual shaving apparatus having a plurality of cutting heads mounted on a flexible base, and more particularly to a shaver having a cloth-like flexible base upon which are mounted a plurality of cutting heads functioning according to the principle of mass action, and effective in conforming to both large and small skin contours.

2. Brief Description of the Prior Art

The prior art includes a number of attempts to construct shavers that conform to skin contours. In U.S. Pat. No. 4,979,298 by Pesiri, a shaver is disclosed that has a head portion 12 with a skin engaging surface 16 of flexible material in which are mounted 16 tubular blade units 20. The flexible surface 16 provides a degree of conformance to skin contours, limited by various structural aspects, such as the relatively rigid sides of the head. In U.S. Pat. No. 4,807,360 by Cerier et al., a body (housing) is made of elastomeric material which provides flexibility. Tubular blades 4 are mounted in the body and supported by a sponge like member 11. The body of Cerier et al. also has sides and other structural aspects that limit the flexibility and relative conformance to body contours.

A more flexible shaver is disclosed in U.S. Pat. No. 4,754,548 by Solow. A plurality of individual blade/housing are connected to a handle by ribs, resilient foam, soft rubber or spring means. The relatively large blade/housings and attachment to a handle, limit the flexibility and conformance to skin contours. In addition to the limited conformance to skin contours, the above described shavers are relatively complex in design, and therefore costly. Since the cutting heads/blades of razors rapidly become dull and need replacement, the cost of production is a major consideration. In the Pesiri and Cerier inventions, the housing/body sides limit conformance, and in the Solow invention, the handle and full support of the rigid cutting blades allows only limited conformance/flexibility. In using a shaver, lack of perfect conformance with skin contours must be compensated for by an application of shaver pressure to flatten the skin and force conformance, a procedure which on occasion causes cuts and abrasions.

There is therefore, clearly a need for a shaver which is more economical to produce, and that can conform more fully to skin contours.

SUMMARY OF THE INVENTION

It is therefore an object of the present invention to provide an improved shaver that is economical to manufacture.

It is a further object of the present invention to provide an improved shaver that conforms well to both large and small skin and body contours.

It is a still further object of the present invention to provide a shaver that functions on the principle of mass action.

It is another object of the present invention to provide a shaver that can be constructed from a wider range of materials.

It is a further object of the present invention to provide a shaver that is safer to use.

Another object of the present invention is to provide a shaver that is self aligning and self-organizing.

It is a still further object of the present invention to provide a shaver that has a plurality of cutters of various geometries to accommodate a variety of hair diameters and lengths.

Briefly, a preferred embodiment of the present invention includes a shaver consisting of a flexible cloth-like base material upon which are mounted a plurality of cutting heads. Each head is attached to the base material so as to be flexible in orientation. A preferred head embodiment includes a flat metal structure having an attachment hole for connection to the cloth and an aperture large enough for passage of one or more hairs, the perimeter of the aperture having a sharp edge for cutting the hair. The density, i.e. quantity of heads per unit area is preferably very large, resulting in some overlap of heads. In this dense configuration, the probability of a head engaging a hair is greatly increased, in spite of the somewhat random orientation of each head. This principle is more commonly known as the law of mass action. The dense, small cutting heads in combination with the flexible cloth-like base material provides a structure that easily conforms to large and small skin and body contours.

An advantage of the present invention is improved conformance to skin and body contours, resulting in a reduced incidence of cuts and abrasions.

A further advantage of the present invention is the provision of a lower cost flexible razor.

A still further advantage of the present invention is that it can be safely and effectively used without the aid of a mirror.

A further advantage of the present invention is that the cutting heads can be made from a large variety of materials.

A still further advantage of the present invention is that the variety of cutting heads optimized to various hair types can be incorporated in a single shaving device.

IN THE DRAWING

FIG. 1A shows an overall view of a shaving cloth;

FIG. 1B shows an enlargened view of a portion of FIG. 1A detailing the cutter layout;

FIG. 2G shows a cutter constructed from a cutting chip attached to a filament which additionally serves as protective rails;

FIG. 2H shows a cutter constructed from a cutting chip attached around its perimeter to a portion of a filament;

FIG. 2I shows a V-shaped cutter constructed from two cutter strips attached to a filament;

FIG. 2J shows a cutter constructed from a single flat piece of metal with crimping sides for attachment to a filament;

FIG. 2K shows the cutter for FIG. 2J attached to a filament;

FIG. 2L shows a cutting chip holder having a chip captivation slot;

FIGS. 6A and 6B show a cutter configuration that can be manufactured from brittle materials, having an attachment including a semi-circular cutout and a spring retainer clip;

FIG. 7A shows a flexible strip cutter assembly attached to a base material;

FIG. 7B illustrates a means of embedding cutters in base material;

FIG. 7C illustrates a shaving apparatus constructed from interwoven ribbons with embedded cutters;

FIG. 8 shows a shaver cloth having cutters embedded in a flexible sheet base material;

FIG. 10 shows a cutter with two cutting apertures;

FIG. 11 shows a cutter with two cutting blades stamped from a single piece of metal;

FIG. 12 shows a cutter having two cutting blades captivated in a molded body;

FIG. 13 illustrates the operation of a single dual blade cutter;

FIG. 14 shows a single blade cutter formed from stamping a single piece of metal;

FIG. 15 illustrates the use of two single blade cutters for cutting hair;

DESCRIPTION OF THE PREFERRED EMBODIMENT

Figure 2A:
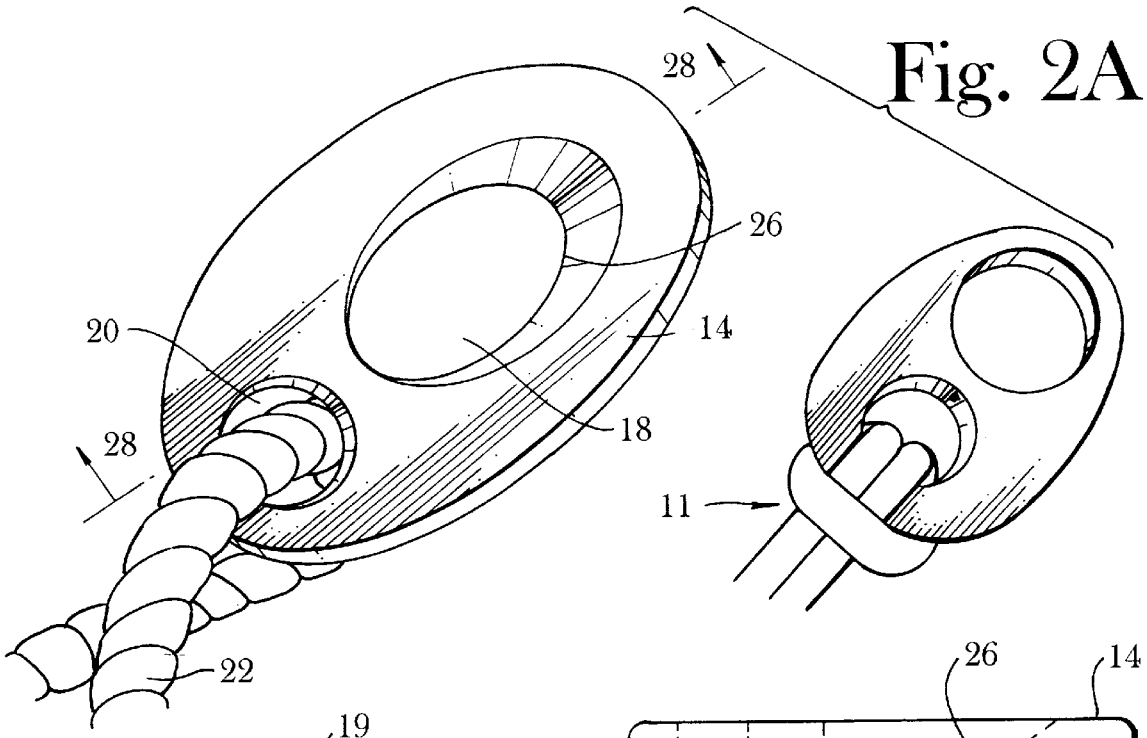
FIG. 2A shows further detail of a cutter head and means of attachment to a cloth.

Referring now to FIGS. 1A and 1B of the drawing, there is shown a preferred embodiment of the shaving cloth 10 of the present invention. A base material 12 is shown upon which are attached numerous cutters 14 indicated in the figures simply as marks. The term "cloth-like" is used to refer to any flexible material in the form of an unsupported sheet, such as that illustrated in FIG. 1A. The preferred embodiment shown in FIGS. 1A and 1B is an actual cloth with filaments/threads, but could also be constructed of other flexible material such as rubber or plastic, etc. with corresponding appropriate means of attachment of the cutters 14, which can be done in a variety of ways known to those skilled in the art, such as a layer of filament embedded within a rubber sheet, etc. The area 16 of FIG. 1A is displayed in an enlargened view in FIG. 1B. Each of the cutters 14 has an aperture 18 and an attachment hole 20. The aperture 18 has a diameter greater than one or more hairs. A fiber i.e. strand from the base material, or a strand that is part of the base material weave, is fed through the attachment hole 20 to secure the cutter 14 to the material 12.

As illustrated in FIGS. 1A and 1B, the cutters 14 can be oriented in various directions and angled as a result of the flexible attachment method provided by the hole 20 and filament 22, or other flexible attachment method allowing movement of the cutters relative to the material about the point of attachment. For clarity of illustration, the density of cutters is generally reduced in FIG. 1B to show them more clearly. However, in practice, the density of cutters is much greater, usually resulting in cutter overlap, such as at 24. The flexible attachment method of hole 20 and filament 22 allows the cutters to conform to skin/body contours more readily than a cutter that is fixed in position on a flexible base material. The cutter 14 and method of attachment shown in FIGS. 1A, 1B, and 2A–2B, as well as others in the figure of the drawing as given by way of example, and other cutter and attachment methods providing a flexible attachment to a flexible base material are also included in the spirit of the present invention.

The combination of a high density of cutters combined with a flexible and somewhat random orientation performs the shaving function on a principle that will be referred to as the law of mass action. Applying the term to the shaving cloth of FIG. 1 means that although some cutters may be oriented so as to disallow reception of a hair, the number of cutters is large enough to result in a high degree of probability that one cutter will intercept and shave each hair. The cutters 14 are preferably designed with very small overall dimensions, which allow the cutters to conform to body and skin contours. The cutter maximum dimensions should generally be less than 0.25 inch, with a preferred size of 0.125 inch in length and less in width for the embodiment shown in FIGS. 1 and 2. It should also be noted that due to the flexible attachment method, the user does not have to be concerned with the orientation of the shaving cloth. The flexible attachment means allows the cutter to align its length with the motion of the cloth against the body, drawing the aperture cutting edge forward. Other shapes of cutter and corresponding aperture will also function in the invention. Such modifications will be apparent to those skilled in the art of shaver design.

Figure 2B:
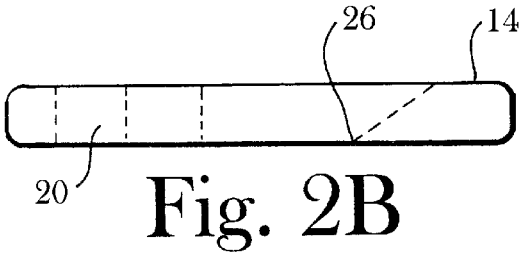
FIG. 2B is a side view of the cutter of FIG. 2A.
Figure 2C:
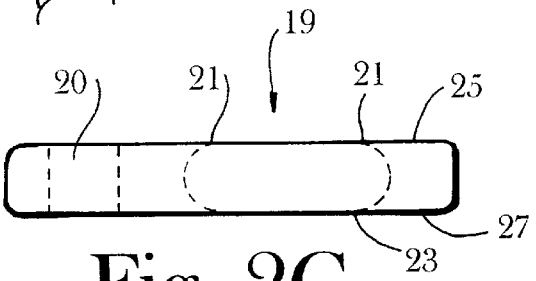
FIG. 2C shows a side view of a cutter similar to FIG. 2A with an alternate cutting edge.
Figure 2D:
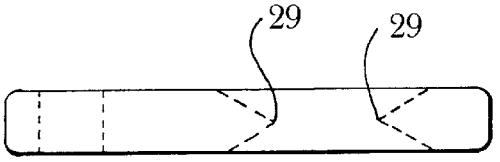
FIG. 2D shows a side view of a cutter similar to FIG. 2A with an alternate cutting edge.

FIGS. 2A and 2B show the preferred embodiment of the cutter 14 and the method of attachment in more detail. FIG. 2A shows filament 22 fed through hole 20 for securing the cutter 14 to the base material 12. An alternate method of tying the cutters 14 to a filament 22 is shown at 11. This method preferentially orients the cutter. The aperture hole 18 has a sharp tapered perimeter edge 26. This sharp edge 26 is necessary on the aperture side located most distant from the hole 20 as illustrated, positioned to be substantially perpendicular to the direction of travel as the base material is moved on the skin. The sharpened edge could also extend around the perimeter of the aperture. The edge 26 is more clearly shown in the side view of the cutter 14 of FIG. 2B. Examples of some alternate cutting edge configurations are shown in FIGS. 2C and 2D. FIG. 2C shows a cutter 19, similar to cutter 14, except with a concave aperture perimeter forming cutting edges 21 and 23 on sides 25 and 27 respectively. The benefit of cutting edges on both sides of the cutter is that the probability of a cutter achieving the closest cut is increased. FIG. 2D shows a single cutting edge 29 midway between the two sides of the cutter, which could be formed, for example, by countersinking both sides of the cutter. The cutting edge could also be configured in other ways known to those skilled in the art.

Figure 2E:
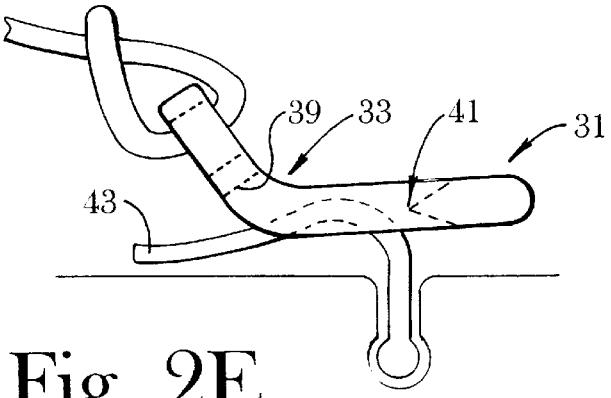
FIG. 2E shows a cutter formed from a flat material and bent at an angle to displace the filament attached thereto and to provide improved clearance for a hair to engage the aperture cutting edge.

FIG. 2E shows a modified embodiment 31 of the cutter of FIGS. 2A–2D wherein the cutter is bent at an angle. The bend occurs in the region of the aperture 33 so as to remove the opposing edge 39 of the aperture 33 from the plane of the cutting edge 41. The purpose of the bend is to allow easier access to a hair 43.

Figure 2F:
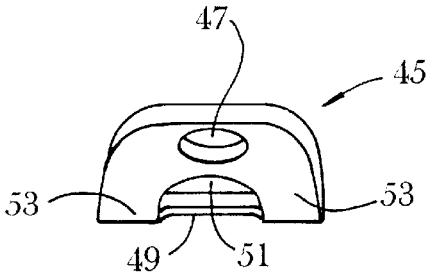
FIG. 2F shows a flat cutter with a recessed cutting edge.
Figure 3A:
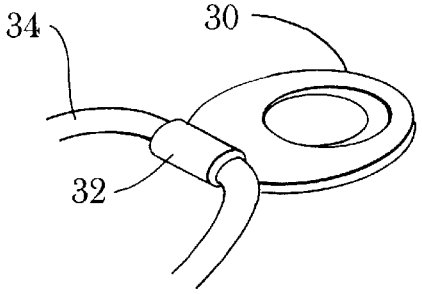
FIGS. 3A and 3B show a cutter similar to FIGS. 2A and 2B with an alternate attachment method.
Figure 3B:
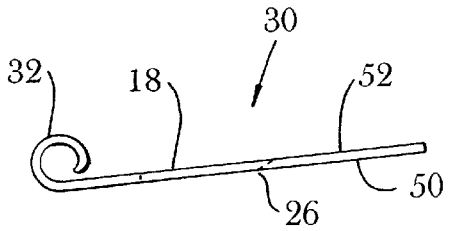
Figure 4A:
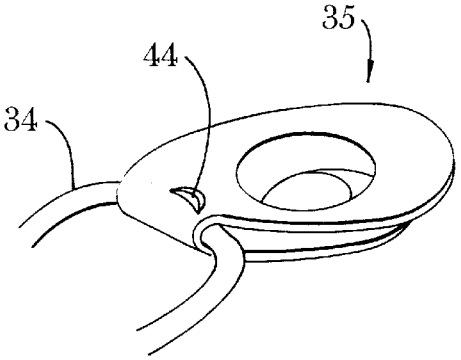
FIGS. 4A and 4B show a dual cutter with an attachment method using tabs.
Figure 4B:
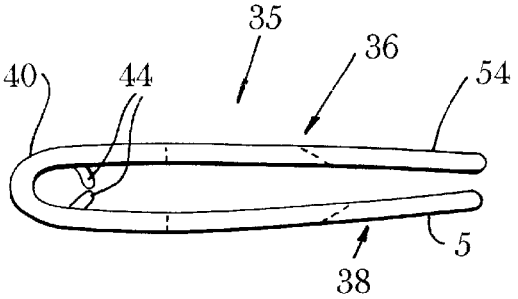
Figure 5A:
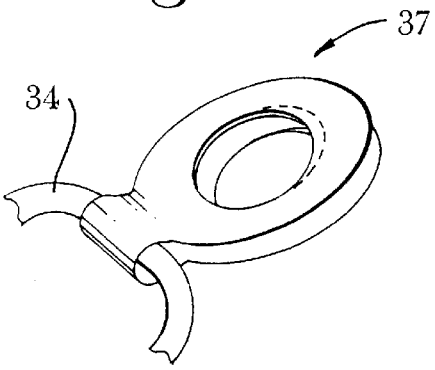
FIGS. 5A and 5B show a dual cutter with an alternate crimped center section for attachment.
Figure 5B:
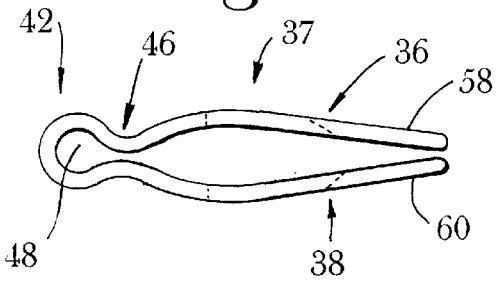

FIG. 2F shows another alternative type of cutter 45 having a hole 47 for attachment to the base material, a recessed cutting edge 49, and an opening 51 for passage of cut hair. The recessed edge 49 in effect allows portions 53 of the cutter 45 to serve as protector rails, keeping the cutting edge 49 from directly contacting the skin.

FIG. 2G shows an alternate preferred embodiment of a cutter design using a small cutter chip 55 with a cutting edge 63, attached with epoxy 57 or other means to a filament 59 attached to the base material. FIG. 2H is similar to FIG. 26 except the cutter 55 is held in place by epoxy or plastic encapsulation 61 of the chip and the filament 59. In FIGS. 2G and 2H, the filament and epoxy capsulation serve as a means to protect the skin from injurious contact with the cutter.

FIG. 2I illustrates the use of two straight cutter pieces 65 with cutting edges 67 forming a V-shaped structure for capturing and cutting hair. Since the cutters are independently attached to the flexible filament 59, they can move relative to each other, resulting in a scissor type of cutting action. Other structures creating a V-shaped structure, or substantially V-shaped, will be apparent to those skilled in the art and are included in the spirit of the present invention.

FIGS. 2J and 2K show a cutter 69 with a cutting edge 71 that can be formed from a single flat piece of metal. The ends 73 are turned over for crimping a filament 59 as shown in FIG. 2K.

FIG. 2L shows a blade holder 75 with ends 77 for crimping to a filament in a manner similar to the cutter of FIGS. 2J and 2K. The holder 75 has a slot 79 with spring or crimped tabs 81 for retaining a cutter 93 with a cutting edge 85 when inserted in the holder.

FIGS. 3–6 show alternate cutter embodiments. FIGS. 3A and 3B illustrate a cutter 30 similar to cutter 14 of FIGS. 2A and 2B except the method for attachment is a crimped tail 32 looped around the filament 34. FIGS. 4A, 4B and 5A, 5B show alternate embodiments using dual cutters. The dual cutters have a first cutting portion 36 and a second cutting portion 38, manufactured from a single piece of material with center sections 40, 42 separating the first and second portions. The material is bent at the center section to place the first and second portions substantially parallel to each other. The cutter 35 of FIGS. 4A and 4B is attached to a filament 34 by crimping tabs 44 around the filament 34. The cutter 37 of FIGS. 5A and 5B is somewhat similar in that the center section 42 as a whole is crimped at 46 to form a channel 48 to capture the filament 34. The cutter designs of FIGS. 4A, 4B and 5A, 5B provide an increased probability of cutting a hair as short as possible. For example, referring back to FIGS. 3A and 3B, hair entering the aperture 18 from side 50 of cutter 30 will be cut shorter than hair entering from side 52, due to the cutting edge 26 being adjacent to surface 50 and away from surface 52. Also, the tail 32 interferes with surface 52 making contact with the skin. The cutters 35 and 37 of FIGS. 4A, 4B and 5A, 5B increase the probability of a close shave due to the fact that two surfaces, 54 and 56 shown in FIG. 4B, or 58 and 60 of FIG. 5B make optimum contact with the skin.

FIGS. 6A and 6B show a further embodiment 80 of the cutter. The shape is similar to that of the cutter 14 of FIG. 2 except that a groove 62 is formed around the perimeter of the cutter, and instead of a hole 20 for attachment, there is a cutout 64. The cutter 58 is captivated by securing a filament 22 in the cutout 64 by a snap ring 66 positioned in the groove 62. The shape of the groove is more clearly shown in FIG. 6B.

The cutting edges shown in FIGS. 2–6 and methods of attachment are given by way of example. Other cutter shapes and attachment methods will be apparent to those skilled in the art, and these variations are included in the spirit of the present invention. The invention also includes any flexible backing material, the actual use of cloth for a base material and the use of "filaments" to attach cutters being a preferred embodiment. The small cutter size, flexible attachment and large quantity of cutters in combination with the flexible cloth-like type of backing provides a novel and useful combination capable of safely following body contours in a manner not shown or anticipated in the prior art.

Alternate embodiments of the shaver apparatus are illustrated in FIGS. 7A, 7B, 7C and 8. In these embodiments, cutting heads 68 are attached to a flexible plastic material. In FIG. 7A, the cutters 68 are captivated in a strip 70 of flexible plastic material and the strip 70 is attached to a flexible base material 74, for example by stitching 72. FIG. 7A shows only three strips 70 for ease of illustration. A practical embodiment would have a large density of strips 70 attached to the base material 74. A typical base material size might be a square several inches on a side. As with the other embodiments shown in the specification, the actual size and shape of the base material is a matter of design preference, and these variations are included in the spirit of the present invention. FIG. 7B shows a cross section such as 76 of FIG. 7A of a cutter 68 captivated by a layer of plastic 78. The material 74 of FIG. 7A or 81 of FIG. 8 could be a filament type of fabric or it could be another type of flexible material, such as plastic or rubber. FIG. 7C shows a shaving apparatus 87 fabricated by intervening strips of flexible material 83 with cutters 68 embedded therein as illustrated in FIG. 7B.

FIG. 8 shows a shaving apparatus 82 including the flexible (cloth-like) base material 84 with a large quantity of densely packed cutters 68 captivated therein. Each cutter 68, for example, can be embedded as shown in FIG. 7B, or in other ways which will be apparent to those skilled in the art.

The embodiment of FIG. 8 does not have the advantage of the extremely dense, somewhat overlapped cutters as in the embodiment of FIG. 2. Instead, the functionality of the device of FIG. 8 is due to the very small, closely spaced cutters 68 attached to a very flexible (cloth-like) base material 84. The cutters 68 have a cutting edge 89 that preferably extends over the entire 360° of the aperture 91, and therefore does not require the self alignment feature of the flexibly attached cutters described above for the purpose of aligning the cutting edge. Cutting edges extending over less than 360° can also be used. A large density of cutters and random orientation of the cutting edge will assure the cutting of hair. The small size of the cutters 68 and flexible nature of the material 84 allows the cutters to conform with body contours, providing an improvement over prior art devices, although not as much improvement as the shaving apparatus with flexibly attached cutters as described above. The device of FIG. 8 differs from the prior art in that the cutters are designed as small as possible, and the base 84 is an unsupported (cloth-like) material, allowing it to conform more fully to body contours. The density of cutters in FIG. 8 is limited by the need for spacing between the cutters to retain the cloth-like flexibility of the entire shaving apparatus structure 82.

Figure 9:
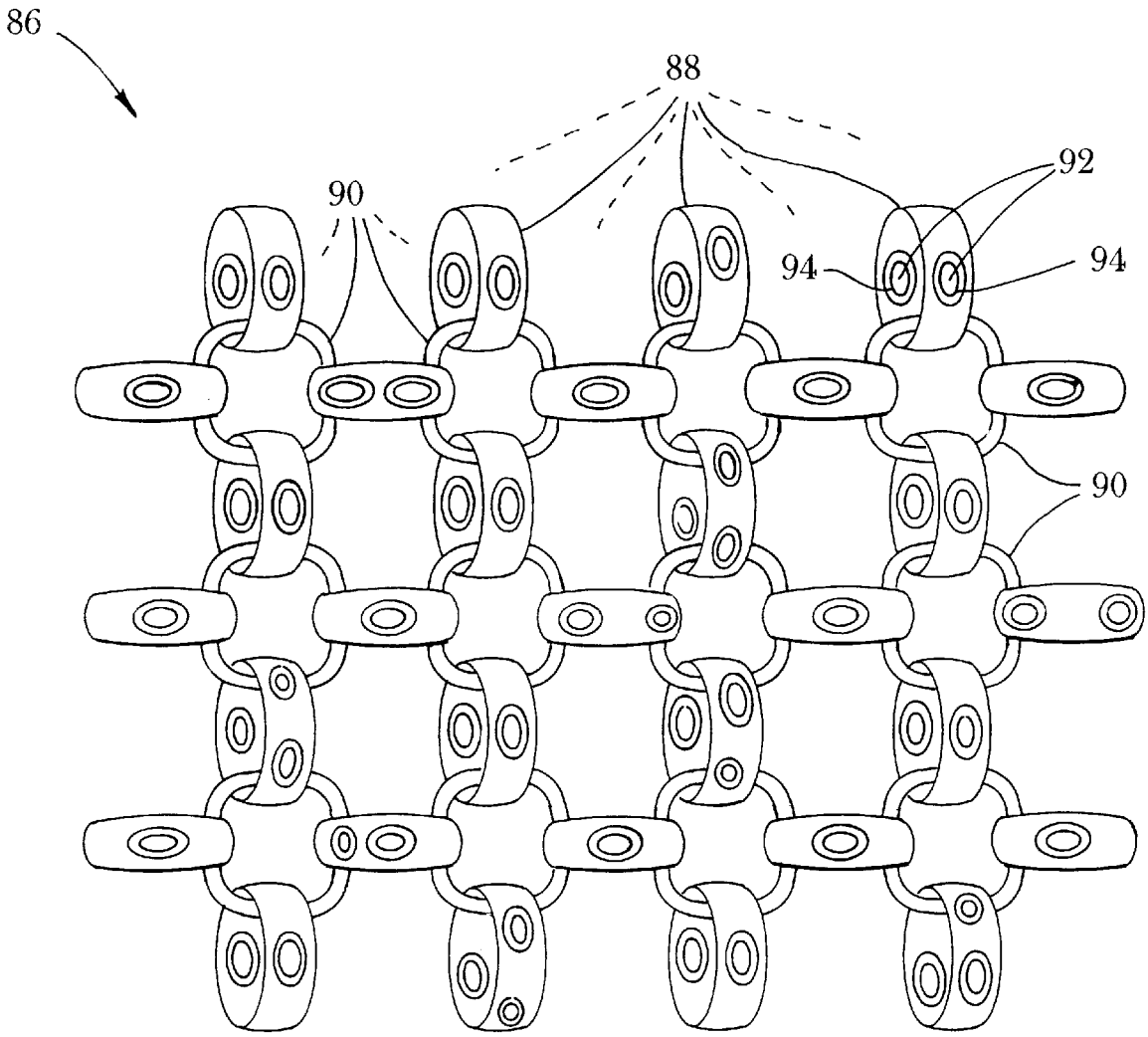
FIG. 9 illustrates a shaver cloth made up of ring cutters interconnected with links.

A further embodiment 86 of the shaving apparatus is shown in FIG. 9 wherein the need for base material is avoided. In this embodiment the cutters 88 are flexibly joined together with links 90. The novel function of a "shaving cloth" is provided as a result of the small cutter size and the overall flexible, cloth-like nature of the mesh structure 86, allowing the cutters to conform to smaller body and skin contours than prior art devices are capable of doing. Although each ring shaped cutter 88 is shown as circular, other shapes are also included in the spirit of the present invention. Each cutter 88 has one or more cutting apertures 92, each aperture having a cutting edge 94. The number and shape of apertures, cutters and links is to a large extent a matter of design choice, and the various alterations and equivalents are included in the spirit of the present invention. In the embodiment shown, the cutters are circular rings with as many as three cutting apertures per cutter. The maximum number of apertures is limited by space considerations. Since each cutter 88 is free to rotate, not all of the apertures will be positioned to intercept and cut a hair. The density of cutters, however, is very large and therefore the probability of interception is adequate and the device performs according to the principle of mass action as previously discussed.

The shaving cloth of the present invention includes any type of cutter attached to a flexible base material, and also includes devices for hair manipulation attached to the base material.

An example of hair manipulation is the use of two cutters on one head. Conventional "safety razors" are optionally constructed with two blades. The theory is that the first blade pulls a hair up as it cuts, and the second blade cuts the hair again before the hair can retract into the skin. In this way the hair is cut shorter, potentially having the retracted cut end below the outer skin level.

In the present invention, dual blade cutters can be used to achieve the above described hair manipulation. For example, FIG. 10 shows a cutter 96 with two cutting apertures 100 and 102, instead of the single aperture of cutter 14 of FIG. 2. An attachment hole 98 is shown for connection to a base material. The first cutting aperture 100 is for pulling and cutting and the second aperture 102 also for cutting as above explained in reference to the conventional form of dual blade safety razor. The attachment method and shape of aperture are shown by way of illustration, and other attachment methods and shapes of apertures are also included in the spirit of the present invention.

An alternate embodiment of a dual blade cutter 104 is shown in FIG. 11. Two blades 106 and 108 are formed from a stamping of a single piece of metal 110. The holes 113 and 115 are useful in flushing/exiting shaving debris. Sides 112 and 114 are formed to present skin bearing surfaces 111 and 117. A crimped extension 116 is shown for connection to a filament attached to the base material. FIG. 12 shows a further alternate embodiment 119 of the dual cutter wherein a body 118 is formed from a cast material such as plastic, with a filament attachment hole 120 at one end. The two blades 122, 124 are shown partially embedded in the body 118 with clearance 126 around the blade cutting ends 128. A rail 121 and a corresponding rail (not shown) on the opposite side of the body 118, provide protective skin bearing surfaces in the same way as surfaces 115 and 117 in FIG. 11. Holes 123 and 125 are formed through the body 118 to flush the shaving debris.

The above described dual blades are preferably mounted to the base material in a high density manner similar to region 24 of FIG. 1. As with the other cutters described in this specification that are flexibly attached to the base material, the motion and resulting friction between the skin and the cutter results in the cutters self organizing themselves for optimum cutting action. For further illustration of the dual blade action, a single dual blade 104 is shown in FIG. 13 attached to a base material 130 by way of a filament 132 connected to the crimped extension 116 of the dual blade 104. A single hair 136 is shown embedded in skin 138. The figure illustrates one of many possible cutter positions relative to a hair. In the situation illustrated, the first blade 108 is pulling the hair 136 so that the base end of the hair originally at 140 is drawn up to position 142, to a point where the tension is sufficient for blade 108 to cut the hair 136, followed by blade 106 cutting the hair 136. After the cutting, the hair base recedes to position 140 again, pulling the cut end along, possibly below the surface 144 of the skin.

With the shaving cloth, the principle of a dual blade cutter can also be achieved by densely packing single blade cutters. An appropriate type of cutter for this purpose would be one similar to the dual cutter 104, less one blade. Such a cutter 146 is shown in FIG. 14 with a single blade 148, and side rails 150, 152 and a threaded, crimped or snap-on attachment end 154. FIG. 15 illustrates two single blade cutters 156, 158 of type 146 cutting a hair 160. The first cutter 158 pulls the hair 160, moving the base end 162 from a first position 164 to a raised second position 166, whereupon the first and second cutters 158 and 156 cut the hair 160, the cut at 167 determining the cut hair length.

Figure 16:
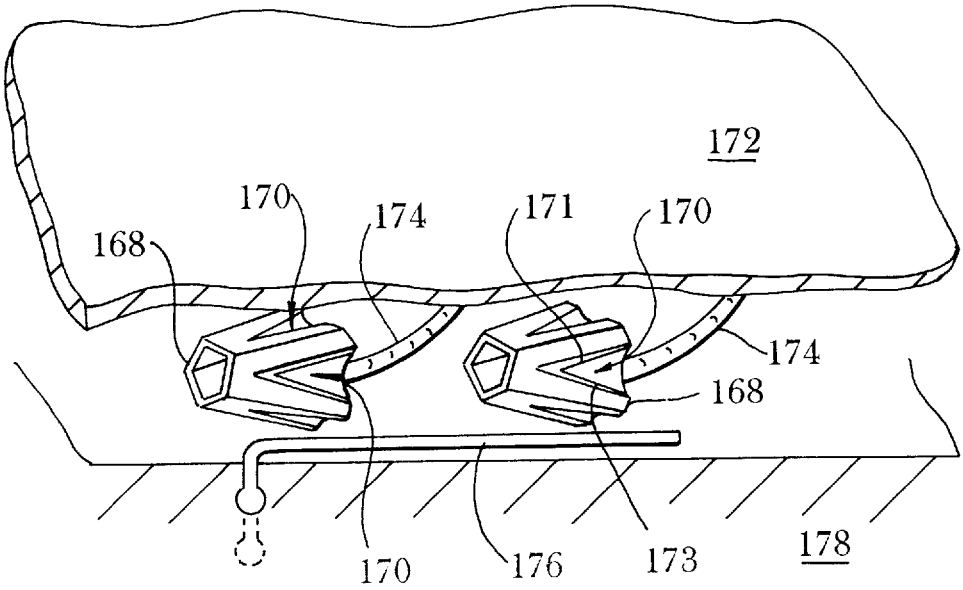
FIG. 16 shows the use of a multi-blade cutter, having like portions of the each cutter on a common circle in a plane substantially orthogonal to the direction of blade pulling force.
Figure 17:
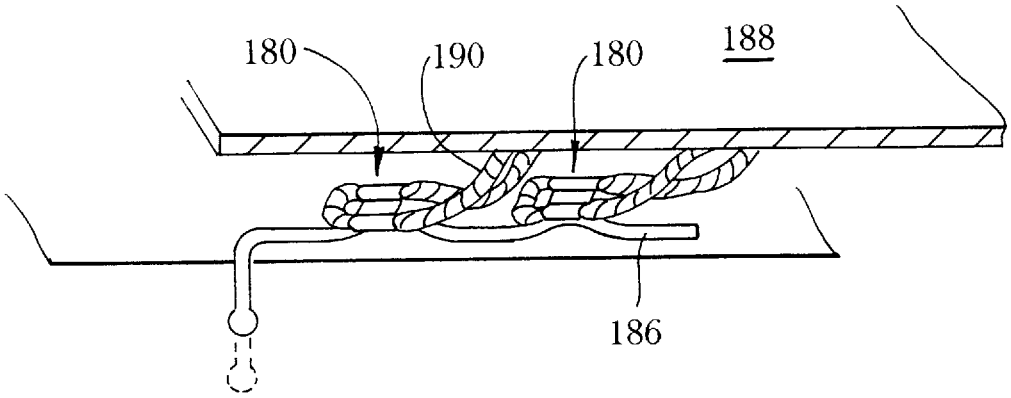
FIG. 17 shows the use of two stamped crimping cutters of the kind illustrated in FIG. 2L to achieve a closer shave.

FIGS. 16 and 17 show further alternate embodiments of cutters that can perform the two blade type of hair manipulation as described in relation to FIG. 15, wherein a first cutter can pull the hair and first and second cutters can cut it to achieve a closer shave. A multi-blade cutter 168 is shown in FIG. 16 having five V-shaped blades 170. Each similar point on the cutting edges 171, 173 of the five blades lies on a common circle lying in a single plane orthogonal to the direction of pulling force applied by filament 174. Two such cutters 168 are shown attached to a base material 172 by filaments 174, in a position for cutting a hair 176 extending from skin 178. FIG. 17 similarly shows two of the cutters 69 of FIG. 2J, each cutter attached to material 188 by filaments 190.

The materials from which the flexible base material and cutters for the various embodiments are made, can be of various types that will be apparent to those skilled in the art after reading the specification of the present invention. In the embodiment of FIG. 2, the base material is preferably a nylon fabric and the cutters a stainless steel alloy designed for razors. The base material can also be made of suitably flexible rubber or plastic. The cutters can be constructed from any of a variety of hardened metals or ceramics. It should also be noted that softer metals can be used than in traditional shaver designs because the edge can be coined. These materials will be apparent to those skilled in the art. The cutter embodiments shown in FIGS. 2G, 2H, 2I, 2L, are particularly adaptable to the use of small exotic chip materials such as ceramics, mineral crystals (e.g. sapphire), because each chip is very small and the volume of material is therefore small. The more brittle materials hold a sharper edge, and are safe to use due to the protective method of housing them, providing some sort of structural support, such as a rail as a spacer between the skin and the cutting edge. For example, the function of protective rails is served by the filament 59 and/or epoxy 57 in FIGS. 2G and 2H, and holder ends 77 in FIG. 2L. The sizes of the apertures displayed in the above embodiments are designed to be greater than the diameter of a hair. The overall size of each cutter is preferably less than 0.25 inch and optimally about 0.125 inch. Other sizes can be used to a lessor advantage.

Different types of cutters, and/or cutters with different apertures or blade angles can be intermixed on a single base material. Such an arrangement accommodates a variety of hair sizes and other characteristics.

Figure 18:
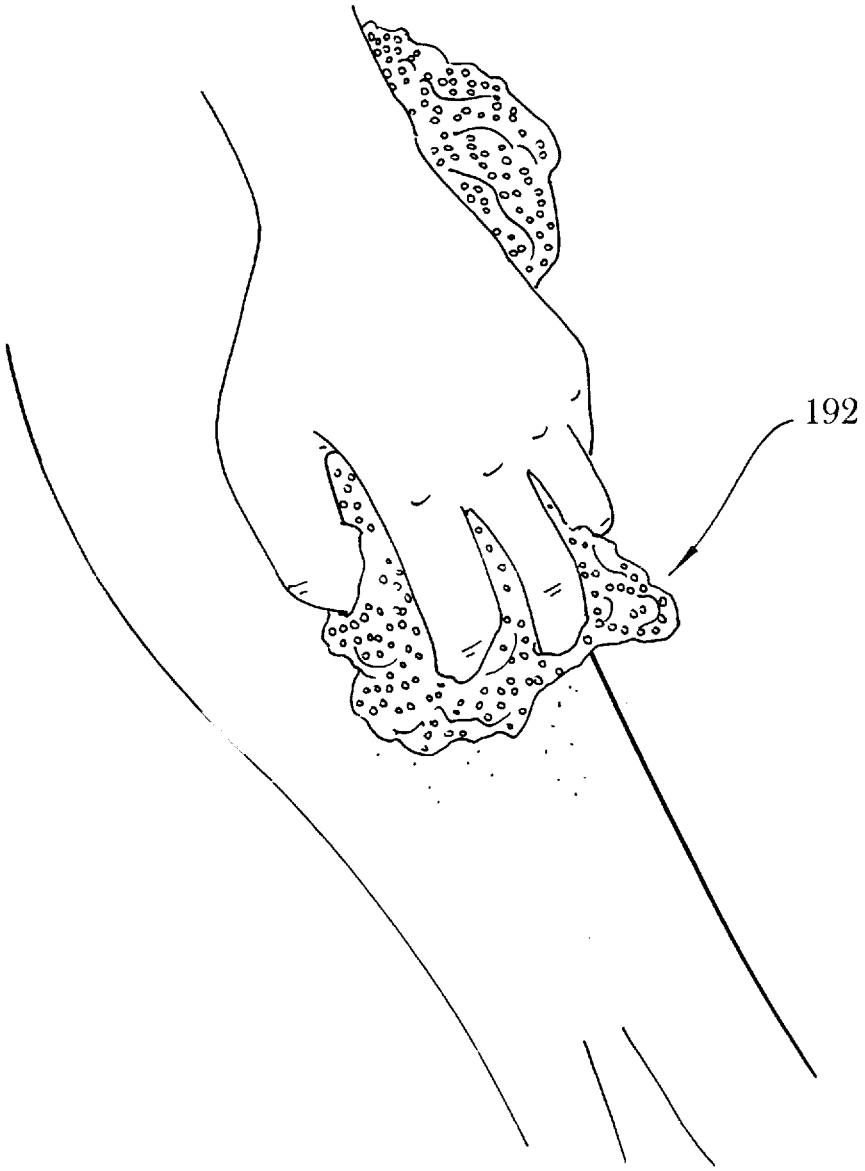
FIG. 18 illustrates the use of the shaving apparatus and its self aligning feature.

Reference to FIG. 18 illustrates the use of a shaving apparatus 192 with any of the cutters disclosed and the fact that the shaving apparatus/shaving cloth can be held in any manner in its use. The flexibly attached cutters described above are self aligning, i.e. pulled into alignment by the movement of the base material working against the resistance of the cutters against the skin and hair. In the case of the shaving apparatus with embedded cutters of FIGS. 7A–7C and FIG. 8, the apparatus can also be used without consideration to alignment. In this case, the cutters do not self align themselves flat with the skin, and also can not be as densely packed as the flexibly attached cutters. The protected 360° cutting edge, or high density and random cutter orientation, assures that no user attention need be given to alignment of the shaving apparatus.

Although preferred embodiments of the present invention have been described above, it will be appreciated that certain alterations and modifications thereof will be apparent to those skilled in the art. It is therefore intended that the intended claims be interpreted as covering all such alterations and modifications that fall within the true spirit and scope of the invention.

What is claimed is:

1. A shaving apparatus comprising:

(a) a plurality of cutters wherein each said cutter is in the shape of a ring with one or more cutting apertures formed therein; and (b) means for flexibly joining said cutters together including a plurality of rings looped through said cutters.

2. A shaving apparatus comprising:

(a) a flexible unsupported sheet material that is foldable and crushable in a user's hand in a manner similar to a washcloth;

(b) a plurality of cutters, wherein said cutters include a first plurality of cutters, each of said first plurality of cutters having more than one cutting surface, whereby a first of said cutting surfaces can pull a hair and both said first and second of said cutting surfaces can cut said hair to achieve a closer shave; and (c) connection means for attaching said cutters to said sheet material.

3. A shaving apparatus comprising:

(a) a flexible unsupported sheet material that is foldable and crushable in a user's hand in a manner similar to a washcloth;

(b) a plurality of cutters, wherein said cutters include a first plurality of cutters, each of said first plurality of cutters having an aperture with a cutting edge along a perimeter of said apertures; and (c) connection means for attaching said cutters to said sheet material.

4. A shaving apparatus comprising:

(a) a flexible unsupported sheet material that is foldable and crushable in a user's hand in a manner similar to a washcloth;

(b) a plurality of cutters, wherein said cutters include a first plurality of cutters, each of said first plurality of cutters having a first blade and a second blade, said first blade and said second blade configured to intersect a hair at an angle to a surface of skin from which said hair emerges; and (c) connection means for attaching said cutters to said sheet material.

5. A shaving apparatus comprising (a) a flexible base material;

(b) a plurality of cutters, each said cutter having a cutting edge; and (c) connection means for attaching each of said cutters to said base material at a point of attachment said connection means allowing each said cutter to rotate about said point of attachment, and thereby allowing said cutting edge to rotate in orientation around said point of attachment relative to said base material.

6. A shaving apparatus as recited in claim 5 wherein said cutting edge is formed on an edge of a first hole in said cutter.

7. A shaving apparatus as recited in claim 6 wherein said connection means includes a second hole in said cutter for attachment of a filament for attaching said cutter to said base material.

8. A shaving apparatus as recited in claim 6 wherein said connection means includes a means for crimping onto a filament for attaching said cutter to said base material.

* * * * *